US007585040B2

(12) United States Patent
Ochiai et al.

(10) Patent No.: US 7,585,040 B2
(45) Date of Patent: Sep. 8, 2009

(54) PRINTING APPARATUS AND PRINTING METHOD

(75) Inventors: Takashi Ochiai, Tokyo (JP); Tsuyoshi Shibata, Yokohama (JP); Hiromitsu Yamaguchi, Yokohama (JP); Eri Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 11/295,501

(22) Filed: Dec. 7, 2005

(65) Prior Publication Data

US 2006/0119660 A1 Jun. 8, 2006

(30) Foreign Application Priority Data

Dec. 8, 2004 (JP) ..... 2004-355891

(51) Int. Cl.
*B41J 2/15* (2006.01)

(52) U.S. Cl. ..... 347/15; 347/9; 347/40; 347/43; 347/85; 358/1.15; 358/1.9; 358/3.13; 358/3.14; 358/296

(58) Field of Classification Search ..... 347/40, 347/41, 43, 12, 15; 358/1.2, 1.9, 3.17, 3.18
See application file for complete search history.

(56) References Cited

U.S. PATENT DOCUMENTS 4,974,067 A * 11/1990 Suzuki et al. ..... 358/534
5,602,572 A 2/1997 Rylander ..... 358/3.09
5,621,440 A 4/1997 Takahashi ..... 347/12
5,625,391 A * 4/1997 Hirabayashi et al. ..... 347/41
5,831,642 A * 11/1998 Matsubara et al. ..... 347/9
5,841,451 A * 11/1998 Hirabayashi et al. ..... 347/41
6,126,261 A 10/2000 Yamanaka
6,328,404 B1 * 12/2001 Fujimori ..... 347/15
6,439,687 B1 * 8/2002 Inoue ..... 347/41
6,557,964 B2 5/2003 Kawatoko et al.
6,655,773 B2 12/2003 Gotoh et al.
7,070,253 B2 7/2006 Yashima et al.
2002/0024548 A1 * 2/2002 Gotoh et al. ..... 347/15
2002/0097286 A1 * 7/2002 Yasuda ..... 347/12

(Continued)

FOREIGN PATENT DOCUMENTS

JP 3-208656 9/1991

(Continued)

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

A printing apparatus divides printing elements of a printhead into blocks, time-divisionally drives the printing elements, and prints a halftone image on a printing medium in accordance with a result obtained by performing digital-halftoning for input multi-valued image data in each matrix of a predetermined size. The apparatus includes a scanner for reciprocally scanning the printhead, a conveyor for conveying the printing medium in a direction different from a scanning direction of the printhead, and a controller for printing a halftone image in each matrix. An arrayed direction of the printing elements is the convey direction of the conveyor. The controller sets a size of the block to be equal to or an integral multiple of a size of the matrix in the convey direction. The digital-halftoning increases the number of dots from a center of the matrix as a density expressed by the multi-valued image data increases.

7 Claims, 10 Drawing Sheets

U.S. PATENT DOCUMENTS

| | | | | |
|---|---|---|---|---|
| 2002/0101465 | A1* | 8/2002 | Maeda | 347/12 |
| 2003/0081258 | A1* | 5/2003 | Sugizaki | 358/3.14 |
| 2004/0119766 | A1 | 6/2004 | Shibata et al. | |
| 2005/0046653 | A1 | 3/2005 | Yamazaki | 347/15 |
| 2005/0104917 | A1 | 5/2005 | Shibata et al. | |
| 2006/0119632 | A1 | 6/2006 | Ochiai et al. | |
| 2006/0256168 | A1* | 11/2006 | Einat et al. | 347/85 |

FOREIGN PATENT DOCUMENTS

| | | |
|---|---|---|
| JP | 7-232434 | 9/1995 |
| JP | 7-323612 | 12/1995 |
| JP | 2553045 | 8/1996 |
| JP | 11-5298 | 1/1999 |
| JP | 2000-118007 | 4/2000 |
| JP | 2000-198237 | 7/2000 |
| JP | 2000-350026 | 12/2000 |
| JP | 2001-347663 | 12/2001 |
| JP | 2002-29097 | 1/2002 |

* cited by examiner

PRINTING APPARATUS AND PRINTING METHOD

FIELD OF THE INVENTION

This invention relates to a printing apparatus and printing method, and particularly to a printing method and printing apparatus which time-divisionally drive a printhead for printing in accordance with, e.g., an inkjet method and print a halftone image.

BACKGROUND OF THE INVENTION

There have conventionally been proposed, e.g., a wire dot method, a thermal method, a thermal transfer method, and an inkjet method as printing methods of printing apparatuses which print on a printing medium such as paper or a plastic sheet. Of these printing apparatuses, a printing apparatus (inkjet printing apparatus) which adopts the inkjet method of discharging ink from a discharge orifice to print on a printing medium achieves quiet non impact printing and can print at high density and high speed.

Recently, printing at higher speeds and higher densities are required. To meet this demand, a printhead (to be referred to as an inkjet printhead hereinafter) mounted in an inkjet printing apparatus generally has many discharge orifices for discharging ink. Some discharge methods for the inkjet printhead utilize, as ink discharge energy, abrupt ink bubbling upon driving a heating element (to be also referred to as a nozzle heater hereinafter) such as an electrothermal transducer arranged in the discharge orifice. Some discharge methods utilize contraction upon driving a piezoelectric element attached to a nozzle.

Regardless of the employed method, discharge becomes unstable due to pressure interference (crosstalk) between adjacent nozzles when all printing elements are concurrently driven in printing. In addition, a voltage drop by power loss on a common power line becomes large near the printhead owing to a large current. As the number of concurrently driven nozzles increases, the driving voltage applied to a nozzle heater drops much more, and printing stability is impaired. Further, the design of a compact, low cost apparatus is limited such that a power supply sufficient to resist an instantaneous large current is required. This problem is solved by dividing all nozzles into a plurality of blocks each having several to several ten nozzles in an inkjet printhead and sequentially time divisionally driving nozzles in the respective blocks. This driving method is called time divisional driving or block divisional driving.

FIG. 9 is a block diagram showing a general configuration of the driving circuit of an inkjet printhead (to be referred to as a printhead hereinafter) using the time-divisional driving method.

In FIG. 9, M printing elements R01 to RM are commonly connected to a driving voltage VH at one end, and to an M-bit driver 301 at the other end. The M-bit driver 301 receives AND signals of an output signal from an M-bit latch 302 and block enable selection signals (BE1 to BEN) of N bits. The M-bit latch 302 receives signals of M bits output from an M-bit register 303. When a latch signal (LAT) is supplied to the latch circuit, the M-bit latch 302 latches (records and holds) M-bit data stored in the M-bit register 303. The M-bit shift register 303 is a circuit which aligns and stores image data in correspondence with printing elements. The shift register receives image data which is sent via a signal line S_IN in synchronism with an image data transfer clock (SCLK).

In the driving circuit having the above configuration, time-divisional driving signals are sequentially input as the block enable selection signals (BE1 to BEN) to time-divisionally drive N printing elements in respective blocks. That is, a plurality of printing elements of the printhead are divided into a plurality of blocks and time-divisional driven to print.

When the number of time-divisionally driven blocks is large, it is known to attach a block enable selection decoder in order to decrease the number of input signals.

When the number of printing elements in a block is set to N for M nozzles, a signal output from the block enable selection decoder can be formed from (MIN) bits. The relationship between the MIN value and the number (X) of terminals of the block enable selection decoder is Time-Divisional Count (Block Count) NN=M/N=2X The number of enable terminals can be decreased from M/N to X.

However, when the printhead having printing elements arranged on the same line is time-divisional driven block by block, the printing position shifts between blocks because the carriage which supports the printhead moves in the scanning direction. The shift in printing position between blocks becomes large in a printhead which has many blocks and is equipped with the above-mentioned block enable selection decoder.

In order to solve this problem, for example, Japanese Patent Publication For Opposition No. 3-208656 proposes a sequential distribution driving method which prevents the printing shift between blocks by using a printhead configured by inclining a printing element array from the carriage moving direction.

In general, however, the same printhead is driven at various driving frequencies in accordance with the printing mode or a printing apparatus on which the printhead is mounted. For this reason, in a printhead which has many blocks and is equipped with the block enable selection decoder, the highest driving frequency must be assumed to determine the number of blocks. In this case, the method disclosed in Japanese Patent Publication For Opposition No. 3-208656 cannot be used.

As a method of preventing a shift in printing position even in this case, Japanese Patent Publication Laid Open No. 7-323612 discloses a method of divisionally driving printing elements in correspondence with the moving speed when the printhead is scanned.

Japanese Patent Publication Laid Open No. 2001-347663 proposes a printhead in which printing elements are arranged by shifting their positions in consideration of the printing position by time-divisional driving.

In the printing field, a technique of performing digital-halftoning (pseudo-halftoning), i.e., forming a unit matrix (image processing control unit of M×N pixels) from dots in order to implement high-quality printing is well known. In electrophotography, clustered-dot digital-halftoning of fatting dots as the density increases from the center of a matrix used for printing is known particularly as a means for improving color reproducibility of a color image (see, e.g., Japanese Patent No. 2553045). Also in inkjet printing, there is known a technique of improving the image quality by performing digital-halftoning control in a halftone or clustered-dot unit matrix. Examples of this technique are disclosed in Japanese Patent Publication Laid Open Nos. 7-232434, 11-5298, 2000-118007, 2000-198237, 2000-350026, and 2002-29097.

However, these prior art techniques suffer the following problems when printing is done by time divisional driving in digital halftoning by the above mentioned unit matrix.

FIG. 10 is a schematic view showing the relationship between the nozzle array of a printhead, a driving signal for each nozzle, and a dot which is discharged from each nozzle and attached onto a printing medium.

An example shown in FIG. 10 is 1-pass printing in a serial inkjet printing apparatus which prints by reciprocating a carriage which supports a printhead.

As shown in a of FIG. 10, a nozzle array 500 of the printhead is divided into 86, first to 86th sections each having six nozzles from the top of FIG. 10. Each of six nozzles in each section belongs to one of six driving blocks, and the nozzles of the respective blocks are time-divisionally driven in printing. That is, nozzles in the same block are concurrently driven.

In the example shown in FIG. 10, all nozzles are periodically assigned to driving blocks such that the first, seventh, 13th, 19th, . . . nozzles of the nozzle array 500 are assigned to the first driving block, and the second, eighth, 14th, 20th, . . . nozzles are assigned to the second driving block. The first to sixth driving blocks are sequentially driven in ascending order by a pulse-like driving signal 300 shown in b of FIG. 10. As shown in c of FIG. 10, dots 100 are formed from the nozzles onto a printing medium in correspondence with the driving signal.

At this time, the unit matrix size is 8×8. As is apparent from c of FIG. 10 showing the attaching position of an ink droplet, the shape of a dot cluster which forms a unit matrix changes depending on the printing position due to the relationship between time-divisional driving and the unit section size.

The shape difference is generated because the section size is "6" and the unit matrix size in the nozzle array direction is "8" in the example shown in FIG. 10. More specifically, patterns of different shapes each in a predetermined period shorter than the period of the unit matrix in the nozzle array direction are repetitively formed in a predetermined period of 24 pixels which is the least common multiple of "6" and "8". In this manner, the shape of a dot cluster in each unit matrix periodically changes owing to the relationship between the unit matrix size and the unit section size of time-divisional driving. The periodical change appears as periodical density unevenness to the eye, degrading the image quality.

Since the shape of each unit matrix changes depending on the printing position, ink droplets which form adjacent unit matrices come into contact with each other on a printing medium particularly in high speed printing to degrade the image quality with a higher probability, in comparison with a case wherein dot clusters of the same shape are formed.

For this reason, it is desired to form dot clusters of the same shape in unit matrices regardless of the image printing position.

This problem occurs not only in 1-pass printing by the serial printing apparatus. For example, even multi-pass printing or a printing apparatus which supports a full-line type printhead may pose the same problem depending on the relationship between the unit matrix size and the unit section size of time-divisional driving, degrading the image quality.

SUMMARY OF THE INVENTION

Accordingly, the present invention is conceived as a response to the above-described disadvantages of the conventional art.

For example, a printing method and printing apparatus using the printing method according to the present invention are capable of preventing generation of periodical density unevenness and printing at high image quality.

According to one aspect of the present invention, preferably, there is provided a printing apparatus which uses a printhead having a plurality of printing elements, divides the plurality of printing elements into a plurality of blocks, time-divisionally drives the plurality of printing elements, and prints a halftone image on a printing medium in accordance with a result obtained by performing digital-halftoning for input multi-valued image data in each matrix of a predetermined size, comprising: scanning means for reciprocally scanning the printhead; convey means for conveying the printing medium in a direction different from a scanning direction of the printhead; and printing control means for controlling to print a halftone image in each matrix, wherein an arrayed direction of the plurality of printing elements is a convey direction of the convey means, and the printing control means controls printing of the halftone image so as to set a size of the block to be equal to or an integral multiple of a size of the matrix in the convey direction.

The digital-halftoning may include clustered-dot digital-halftoning of fatting dots as a density expressed by the multi-valued image data increases from a center of the matrix, or dispersed-dot digital-halftoning of discretely increasing the number of dots as a density expressed by the multi-valued image data increases from a center of the matrix.

The printing control means may control to perform multi-pass printing.

The printhead preferably includes an inkjet printhead which prints by discharging ink onto a printing medium.

The inkjet printhead desirably comprises an electrothermal transducer for generating thermal energy to be applied to ink, in order to discharge ink by using thermal energy.

According to another aspect of the present invention, preferably, there is provided a printing method for a printing apparatus which uses a printhead having a plurality of printing elements, divides the plurality of printing elements into a plurality of blocks, time-divisionally drives the plurality of printing elements, and while reciprocally scanning the printhead, prints a halftone image on a printing medium in accordance with a result obtained by performing digital-halftoning for input multi-valued image data in each matrix of a predetermined size, comprising: setting an arrayed direction of the plurality of printing elements to a convey direction of the printing medium; and setting a size of the block to be equal to or an integral multiple of a size of the matrix in the convey direction, and controlling printing of the halftone image in each matrix.

The invention is particularly advantageous since generation of periodical density unevenness can be prevented and a halftone image can be printed at high image quality.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "printing" (to be also referred to as "print") is not limited to the formation of significant information such as a character or figure. In addition, in a broad sense, "printing" refers to the forming of an image, design, pattern, or the like on a printing medium or the processing of a medium regardless of whether information is significant or insignificant, or whether information is so visualized as to allow the user to visually perceive it.

"Printing media" are not only paper used in a general printing apparatus, but also ink-receivable materials such as cloth, plastic film, metal plate, glass, ceramics, wood, and leather in a broad sense.

"Ink" (to be also referred to as "liquid") should be interpreted as widely as the definition of "printing (print)". "Ink" represents a liquid which is applied onto a printing medium to form an image, design, pattern, or the like, to process the printing medium, or to contribute to ink processing (e.g., solidification or insolubilization of a coloring material in ink applied to a printing medium).

"Nozzles" comprehensively mean discharge orifices or liquid channels which communicate with them, and elements which generate energy used to discharge ink, unless otherwise specified.

Figure 1:
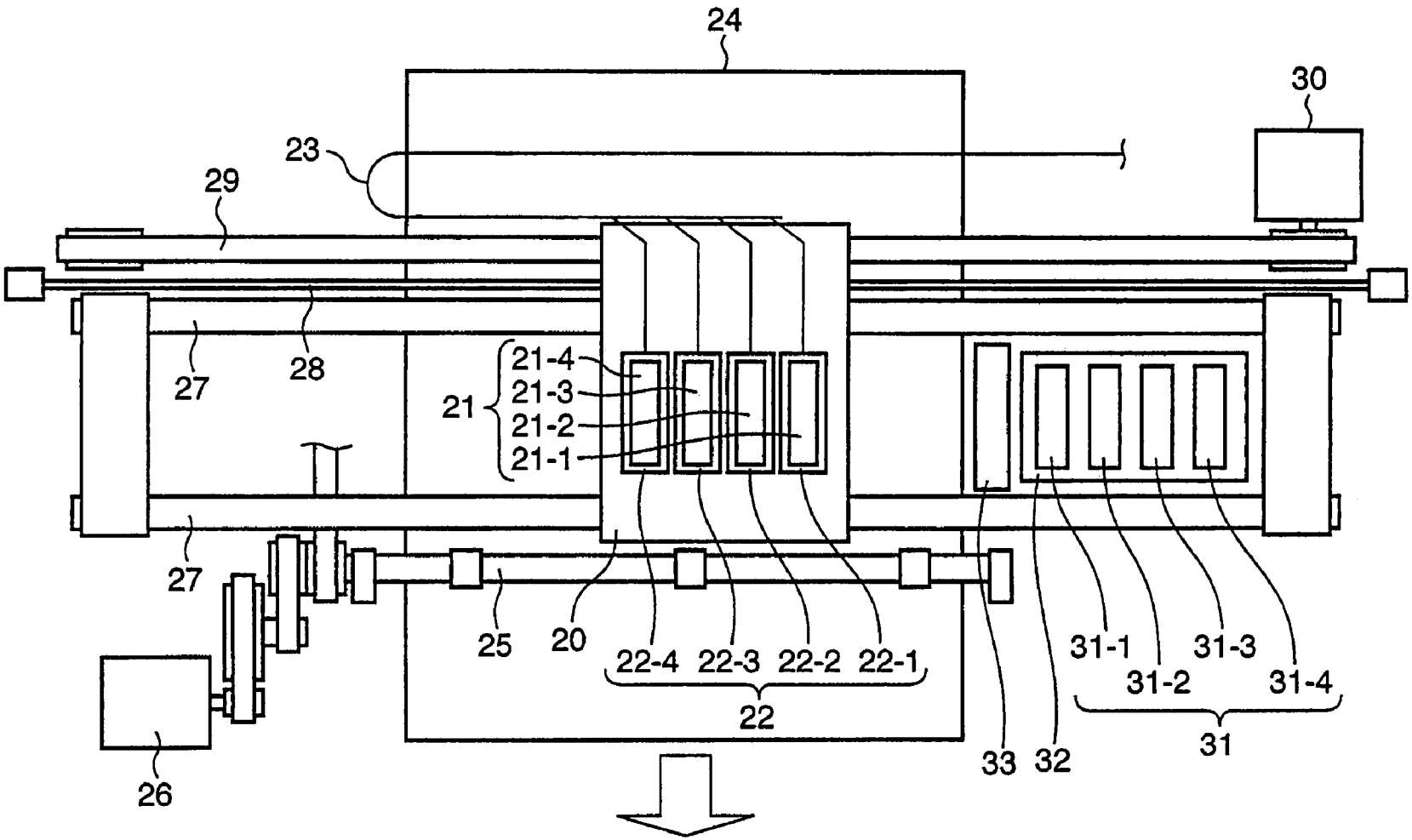
FIG. 1 is a plan view showing the schematic configuration of an inkjet printing apparatus as a typical embodiment of the present invention.

FIG. 1 is a plan view showing the schematic configuration of an inkjet printing apparatus (to be referred to as a printing apparatus hereinafter) as a typical embodiment of the present invention.

As shown in FIG. 1, four inkjet printheads (to be referred to as printheads hereinafter) 21-1 to 21-4 are mounted on a carriage 20, and each printhead has an array of nozzles for discharging ink. These printheads will be generally referred to by reference numeral "21".

Figure 2:
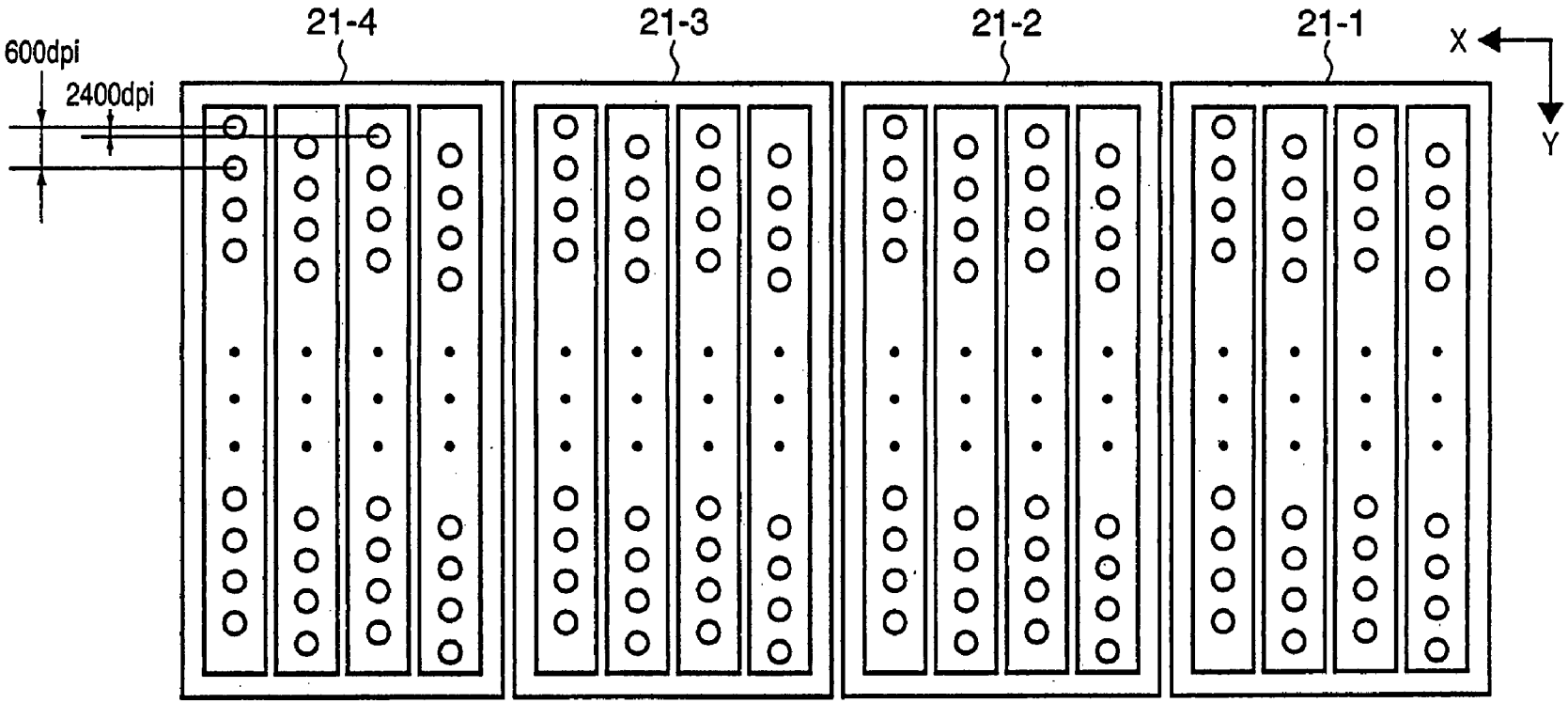
FIG. 2 is a schematic view showing an example of the nozzle layout of a printhead which is mounted on the inkjet printing apparatus shown in FIG. 1.

FIG. 2 is a view showing an example of the nozzle layout of the printhead 21.

The printheads 21-1 to 21-4 respectively discharge black (K), cyan (C), magenta (M), and yellow (Y) inks, and each nozzle discharges an ink droplet of 2 pl on average. As shown in FIG. 2, each printhead has four 600-dpi nozzle arrays on which nozzle positions shift from each other at ¼ of the nozzle interval. Thus, each of the printheads 21-1 to 21-4 has nozzle arrays which are arrayed at a resolution of substantially 2,400 dpi.

In FIG. 2, the X direction is the scanning direction of the carriage 20 which supports the printhead, and also a direction in which an image is printed by discharging ink droplets from nozzles on the basis of image information while the carriage 20 is scanned on a printing medium. The Y direction is a direction in which nozzle arrays are arranged like columns. Each printhead is formed from four nozzle arrays in this example, but may be formed from one or a plurality of arrays. Also, nozzles need not be aligned.

Referring back to FIG. 1, a heating element (electrothermal transducer) which generates thermal energy for discharging ink is arranged in the ink discharge orifice (fluid channel) of the printhead 21. The printheads 21-1 to 21-4 respectively comprise ink tanks 22-1 to 22-4 which supply inks. Each printhead and each ink tank form an ink cartridge, which is not denoted by any reference numeral.

A control signal to the printhead 21 is sent via a flexible cable 23. A printing medium 24 (e.g., plain paper, high-quality dedicated paper, an OHP sheet, glossy paper, a glossy film, or a postcard) passes through a convey roller (not shown), is clamped by a pair of delivery rollers 25 which face each other, and fed in a direction (sub-scanning direction) indicated by the arrow along with driving of a convey motor 26.

The carriage 20 is movably supported by guide shafts 27 and a linear encoder 28. The carriage 20 is driven by a carriage motor 30 via a driving belt 29, and reciprocates in a direction (main scanning direction) which intersects (perpendicular to) the sub-scanning direction along the guide shafts 27. In reciprocation, the linear encoder 28 outputs a pulse signal, and the position of the carriage 20 can be detected by counting pulse signals.

The heating element of the printhead 21 is driven on the basis of a printing signal along with movement of the carriage 20. Then, an ink droplet is discharged and attached onto a printing medium to form an image.

In the main scanning direction in which printing is done on a printing medium, a recovery unit 32 having a capping unit 31 is arranged at the home position of the carriage 20 that is set outside the printing area. While no printing is done, the carriage 20 is moved to the home position and the ink discharge orifices of the printheads 21 are closed by corresponding caps 31-1 to 31-4 of the capping unit 31. This prevents an increase in ink viscosity caused by evaporation of the ink solvent, fixation of ink, or clogging by attachment of a foreign matter such as dust.

The capping function of the capping unit 31 is exploited to preliminarily discharge ink from an ink discharge orifice to the capping unit 31 at a distant position in order to prevent a discharge failure and clogging at an ink discharge orifice whose printing frequency is low. This function is also exploited to operate a pump (not shown) while capping the printhead, suck ink from the ink discharge orifice, and recover the discharge function of a discharge orifice from a discharge failure.

An ink receiving unit 33 is used to perform preliminary discharge when the printheads 21-1 to 21-4 pass above the ink receiving unit 33 immediately before printing is arranged at a position adjacent to the capping unit 31. The ink discharge orifice formation surface of the printhead 21 can be cleaned by arranging a wiping member (not shown) such as a blade at a position adjacent to the capping unit 31.

Note that the inkjet printing method applicable to the present invention is not limited to a bubble-jet method using a heating element (heater). For example, for a continuous printing method of continuously injecting particles of ink droplets, a charge control method, divergence control method, and the like can be applied. For an on-demand printing method of discharging ink droplets, as needed, a pressure control method of discharging ink droplets from orifices by mechanical vibrations of a piezoelectric vibrator can also be applied.

Figure 3:
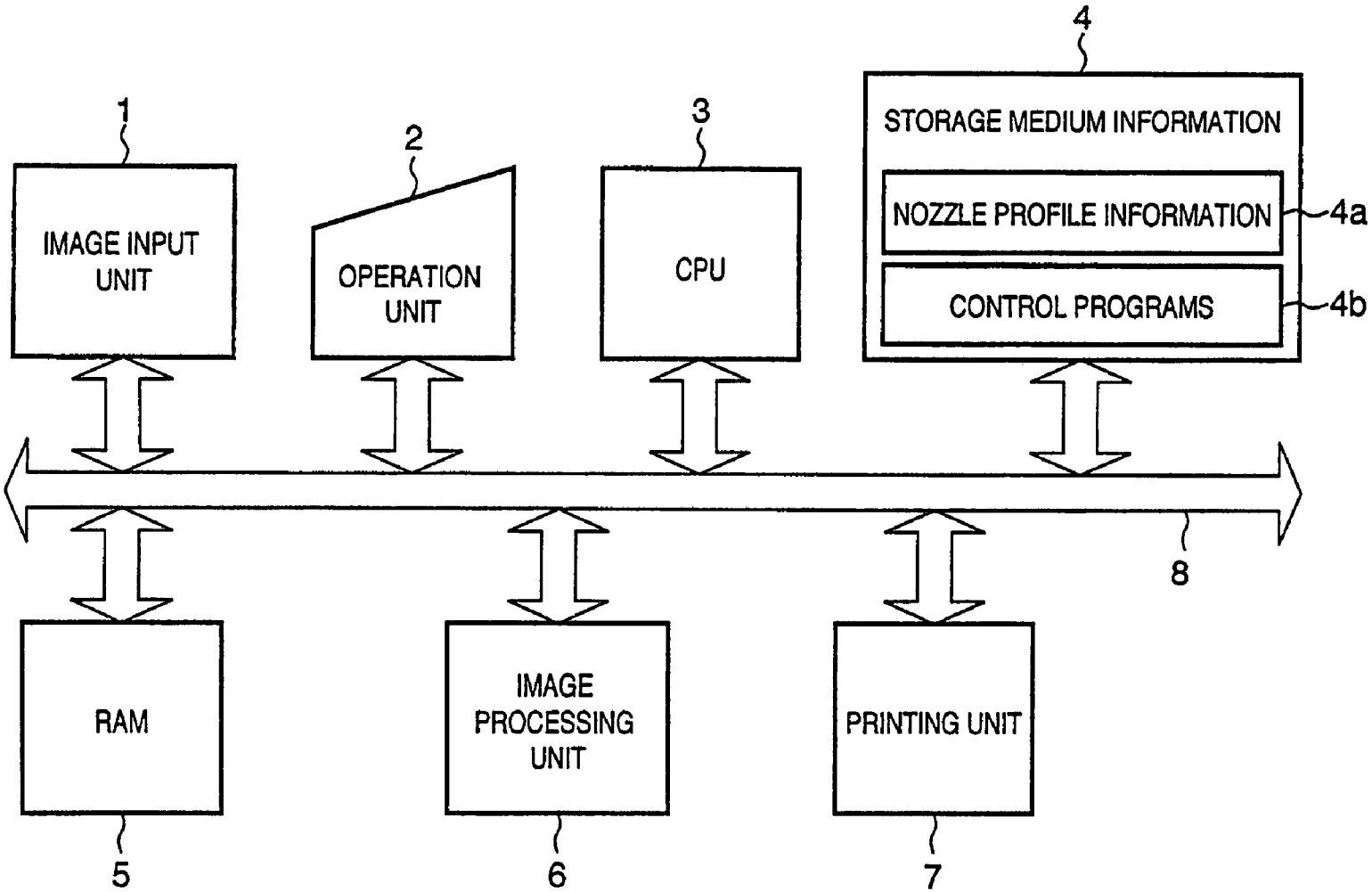
FIG. 3 is a block diagram showing the control configuration of the inkjet printing apparatus shown in FIG. 1.

FIG. 3 is a block diagram showing the control configuration of the printing apparatus shown in FIG. 1.

In FIG. 3, reference numeral 1 denotes an image data input unit which receives multi valued image data from an image input device such as a scanner or digital camera, or multi valued image data saved in the hard disk of a personal computer or the like. Reference numeral 2 denotes an operation unit having various keys used to set various parameters and designate the start of printing; and 3 denotes a CPU serving as a control means for performing various arithmetic processes and control operations (to be described later) in accordance with various programs in a storage medium.

Reference numeral 4 denotes a storage medium which stores a control program and error processing program for controlling the printing apparatus. All printing operations in the embodiment are executed by these programs. The storage medium 4 which stores the programs can be, e.g., a ROM, FD, CD-ROM, HD, memory card, or magneto-optical disk. Reference numeral 5 denotes a RAM which is used as a work area for various programs in the storage medium 4, a temporary save area in error processing, and a work area in image processing. The RAM 5 is also used when various tables stored in the storage medium 4 are copied in the RAM 5, then the contents of the tables are changed, and image processing proceeds by referring to the changed tables.

Reference numeral 6 denotes an image data processing unit which processes image data. The image data processing unit 6 quantizes input multi-valued image data into N-ary image data for each pixel, and generates discharge pattern data corresponding to a gray value "T" represented by each quantized pixel. For example, when multi-valued image data expressed by 8 bits (256 gray levels) for each color component of one pixel is input to the image input unit 1, the image data processing unit 6 in the embodiment converts the gray levels of output image data into 25 (=24+1) gray levels. In the embodiment, T-ary processing for input multi-valued image data adopts the multi-valued error diffusion method. However, the image processing method of performing T-ary processing is not limited to the multi-valued error diffusion method, and may employ an arbitrary halftoning method such as the average density conservation method or dither matrix method. By repeating T-ary processing for all pixels on the basis of density information of the image, binary driving signals representing whether to discharge ink or not are formed for pixels corresponding to ink nozzles.

Reference numeral 7 denotes a printing unit which discharges ink on the basis of the discharge pattern created by the image data processing unit 6, and forms a dot image on a printing medium. The printing unit 7 is formed from the mechanism as shown in FIG. 1 and the like. Reference numeral 8 denotes a bus line which transfers an address signal, data, control signal, and the like in the printing apparatus.

Several embodiments of image processing which is executed using a printing apparatus having the above-described configuration as a common embodiment will be explained.

First Embodiment

A case wherein 1-pass printing is performed by a printhead which substantially has 512 nozzles on one array at a printing resolution of 2,400 dpi and an average discharge amount of 2 pl in the nozzle configuration as shown in FIG. 2 will be described.

Figure 4:
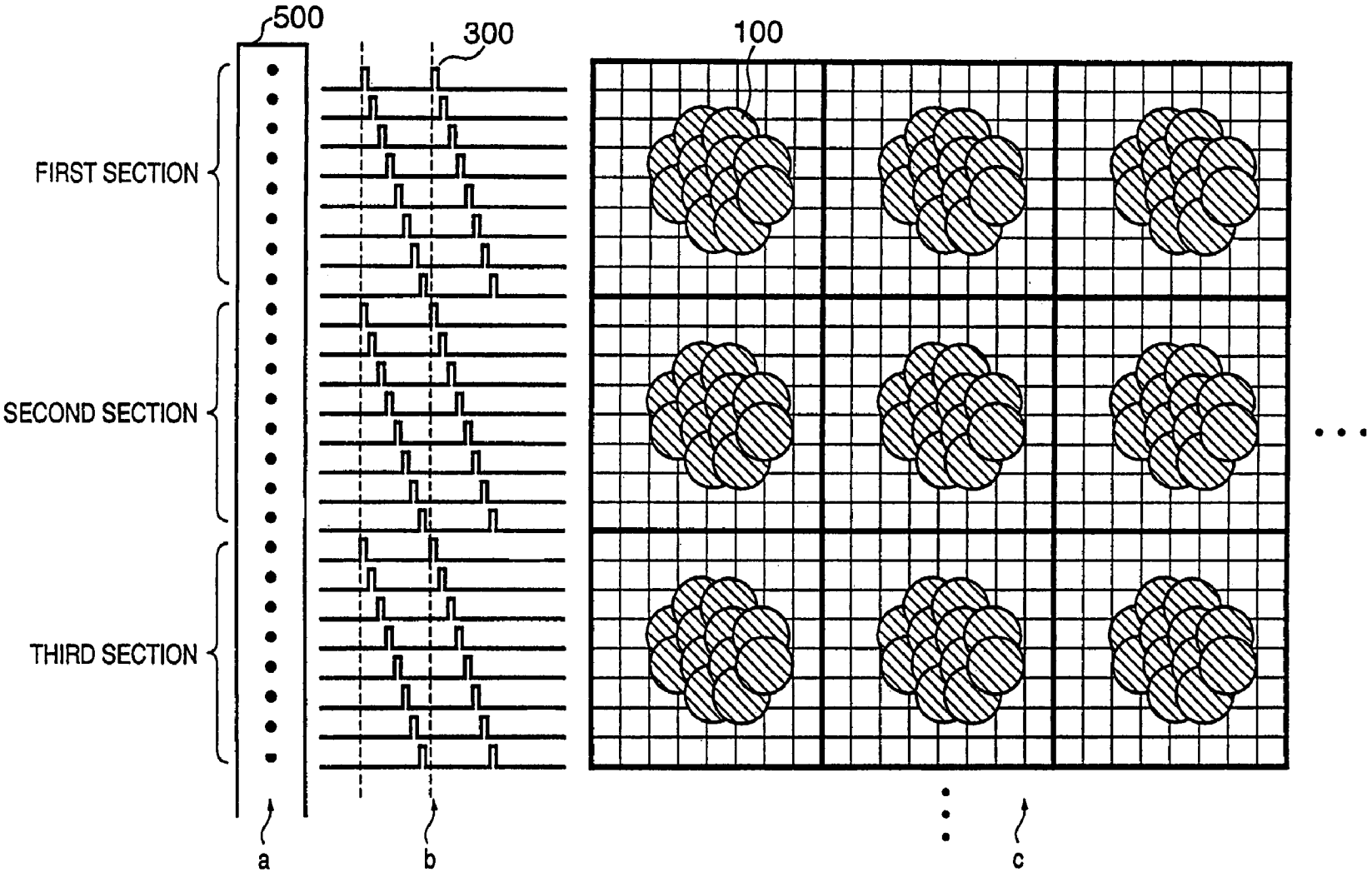
FIG. 4 is a schematic view showing the relationship between the nozzle array of a printhead according to the first embodiment of the present invention, a driving signal for each nozzle, and a dot which is discharged from each nozzle and attached onto a printing medium.

FIG. 4 is a schematic view showing the relationship between the nozzle array of the printhead according to the first embodiment of the present invention, a driving signal for each nozzle, and a dot which is discharged from each nozzle and attached onto a printing medium.

In the example shown in FIG. 4, all the 512 nozzles are periodically assigned to driving blocks such that 64, first, ninth, 17th, 25th, . . . , and 505th nozzles of a nozzle array 500 are assigned to the first driving block, and 64, second, 10th, 18th, 26th, . . . , and 506th nozzles are assigned to the second driving block.

The first to eighth driving blocks are sequentially driven in ascending order by a pulse-like driving signal 300 shown in b of FIG. 4. As shown in c of FIG. 4, dots 100 are formed from the nozzles onto a printing medium in correspondence with the driving signal.

At this time, the unit matrix size is 8×8. Since the resolution of the printhead is 2,400 dpi, the resolution of the unit matrix is 300 dpi. In the first embodiment, the unit matrix undergoes clustered-dot digital-halftoning of fatting dots from the center of the matrix as the density increases. In this case, the unit matrix can express 65 gray levels.

Figure 5:
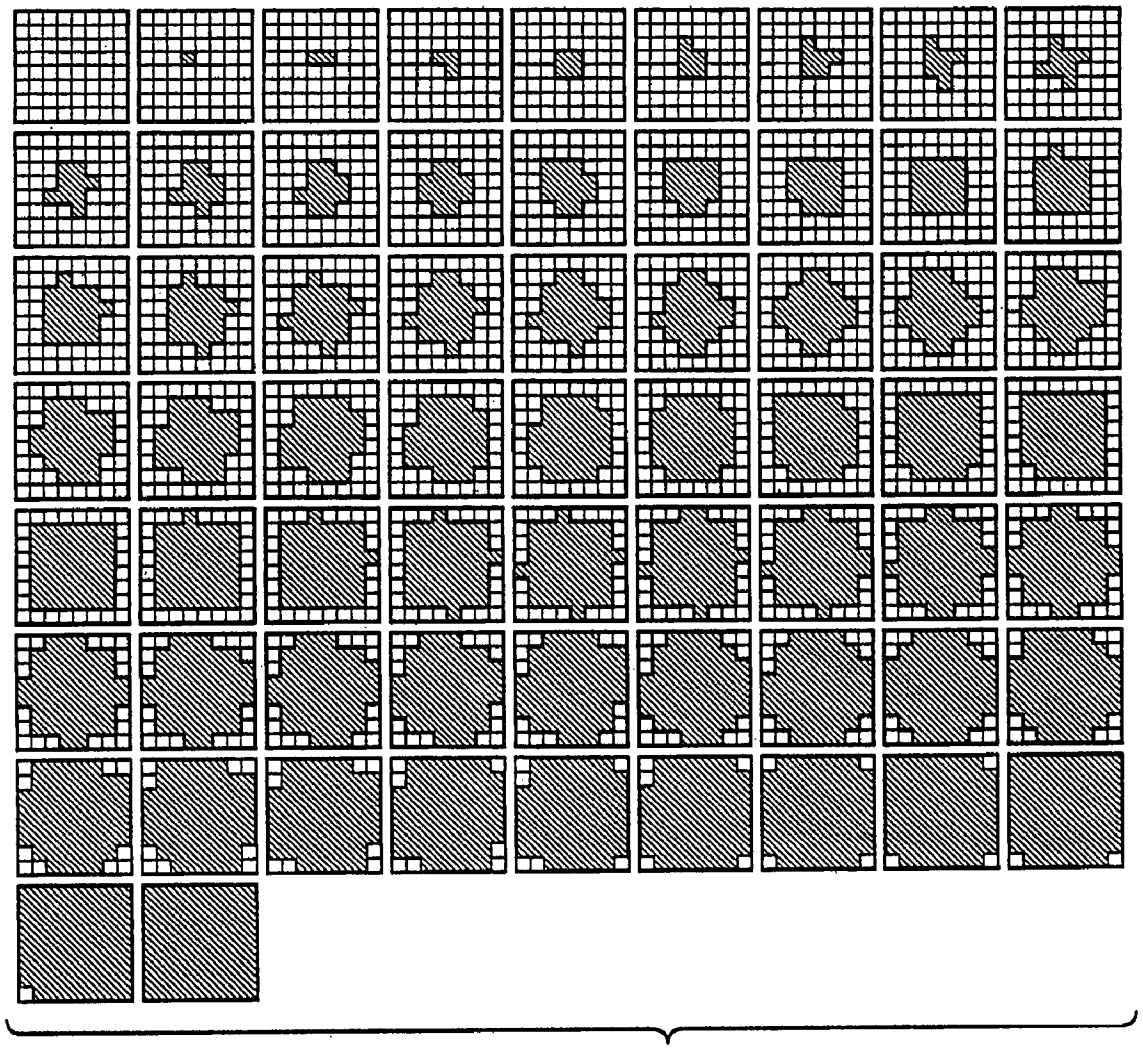
FIG. 5 is a view showing an example of a clustered-dot matrix.

FIG. 5 is a view showing an example of a clustered-dot matrix.

According to the first embodiment, as is apparent from c of FIG. 4 showing the printing position of an ink droplet, dot clusters which form unit matrices have the same shape regardless of the position even in time-divisional driving.

In this case, the section size is "8", and the unit matrix size in the nozzle array direction is "8". The least common multiple is 8, and the period of eight pixels, i.e., the value of the period coincides with the unit matrix size. For this reason, no patterns of different shapes each in a predetermined period shorter than the period of the unit matrix in the nozzle array direction are repetitively formed, unlike the prior art.

Since dot clusters of the same shape are regularly formed at pixel positions, degradation of the image quality under the influence of dots attached on a printing medium particularly in high-speed printing is suppressed in comparison with a conventional case wherein patterns of different shapes are repetitively formed.

As described above, according to the first embodiment, dot clusters of the same shape are formed in unit matrices. Periodical density unevenness can be prevented, an adverse effect between dots attached on a printing medium can be reduced, and high image quality can be implemented.

Second Embodiment

A case wherein the unit matrix size is 16×16 and the printing resolution of the unit matrix is 150 dpi will be described. In this case, graininess is lower than that in the first embodiment. However, each unit matrix can express 256 gray levels (accurately 16×16+1=257 gray levels, but the number of gray levels is 256 at the maximum because input multi-valued image data is 8-bit data for each pixel). Similar to the first embodiment, the unit matrix undergoes clustered-dot digital-halftoning of fatting dots from the center of the matrix as the density increases.

Figure 6:
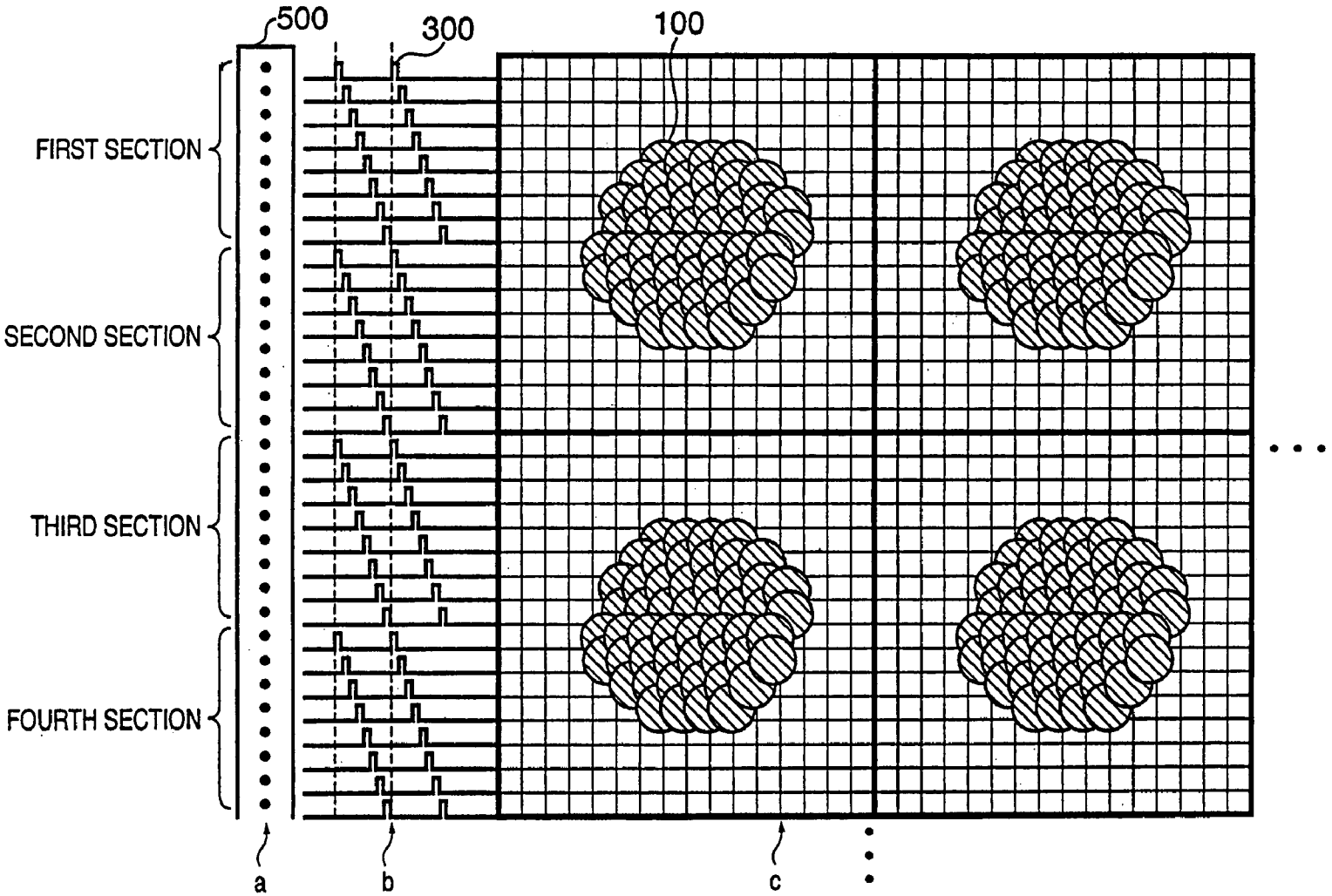
FIG. 6 is a schematic view showing the relationship between the nozzle array of a printhead according to the second embodiment of the present invention, a driving signal for each nozzle, and a dot which is discharged from each nozzle and attached onto a printing medium.

FIG. 6 is a schematic view showing the relationship between the nozzle array of a printhead according to the second embodiment of the present invention, a driving signal for each nozzle, and a dot which is discharged from each nozzle and attached onto a printing medium.

As is apparent from c of FIG. 6 showing the adhered position of an ink droplet, dot clusters which form unit matrices have the same shape regardless of the position even in time-divisional driving. In the second embodiment, the section size is "8", and the unit matrix size in the nozzle array direction is "16" which is twice larger than the section size. The least common multiple is 16, and the period of 16 pixels, i.e., the value of the period coincides with the unit matrix size. For this reason, no patterns of different shapes each in a predetermined period shorter than the period of the unit matrix in the nozzle array direction are repetitively formed.

Since dot clusters of the same shape are regularly formed at pixel positions, degradation of the image quality under the influence of dots adhered on a paper surface particularly in high-speed printing is suppressed in comparison with a conventional case wherein patterns of different shapes are repetitively formed.

As described above, according to the second embodiment, dot clusters of the same shape can be formed in unit matrices. Periodical density unevenness can be prevented, an adverse effect between dots attached on a printing medium can be reduced, and high image quality can be implemented.

In the first and second embodiments, the section size is "8", and the unit matrix sizes in the nozzle array direction are "8" and "16", respectively. However, the present invention is not limited to this. For example, the present invention can be applied when the unit matrix size in the nozzle array direction is an integer multiple of the section size "8", i.e., "32, "64", . . . .

In practice, considering a case wherein an image is printed by performing digital-halftoning for image data enough to express one pixel by 8 bits, the value (n) of the ratio of the unit matrix size in the nozzle array direction of the printhead to the section size suffices to be about n=2. The image quality is traded off for graininess of a printed image, and the value n may be set to n=3 or more when the printing resolution further increases in the future or demands arise for an expression at higher gray levels in the future.

Third Embodiment

The first and second embodiments have described 1-pass printing. The third embodiment will describe an example of forming dot clusters of the same shape at image positions on the basis of the same idea even for multi-pass printing. For descriptive convenience, the third embodiment will exemplify 2-pass printing, but the present invention can also be applied to 4-pass printing and 8-pass printing.

Figure 7:
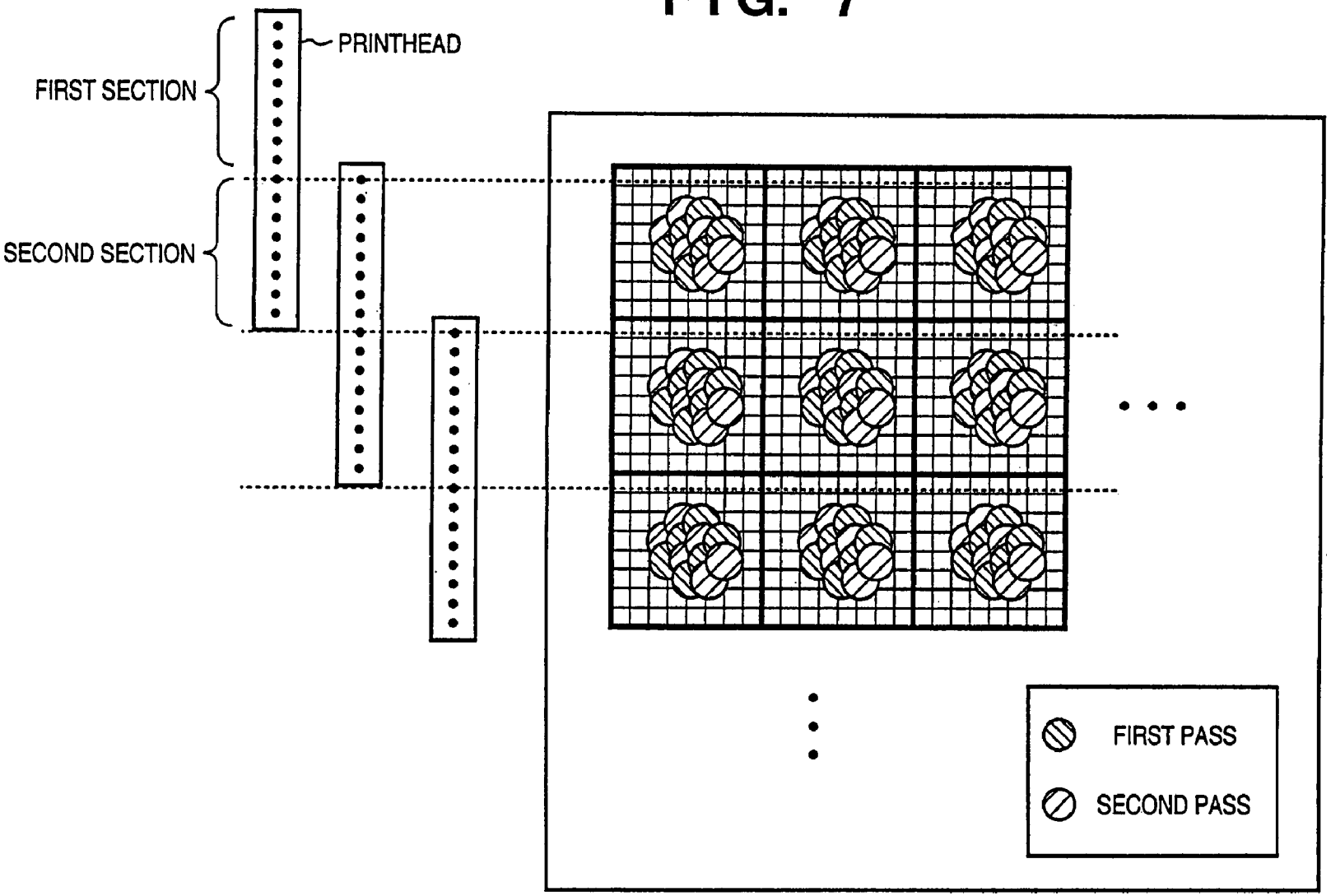
FIG. 7 is a schematic view showing the relationship between each scanning by a printhead and the image position according to the third embodiment of the present invention.

FIG. 7 is a schematic view showing the relationship between each scanning and the image position in 2-pass printing.

In FIG. 7, dots printed by the first pass are dots with small points, and dots printed by the second pass are hatched dots.

In 2-pass printing, printing is done using the latter half of the nozzle array of the printhead for the first pass. For descriptive convenience, the number of nozzles of the printhead shown in FIG. 7 is "16", and the section size in time division is "8". Also in 2-pass printing, similar to the first and second embodiments, printing rasters are printed by the same block, and dot clusters of the same shape can be formed in unit matrices.

In this case, however, the conditions that the number of nozzles of the printhead is exactly divisible by the printing pass count and the quotient is a multiple of the section size must be satisfied, like the above example.

Figure 8:
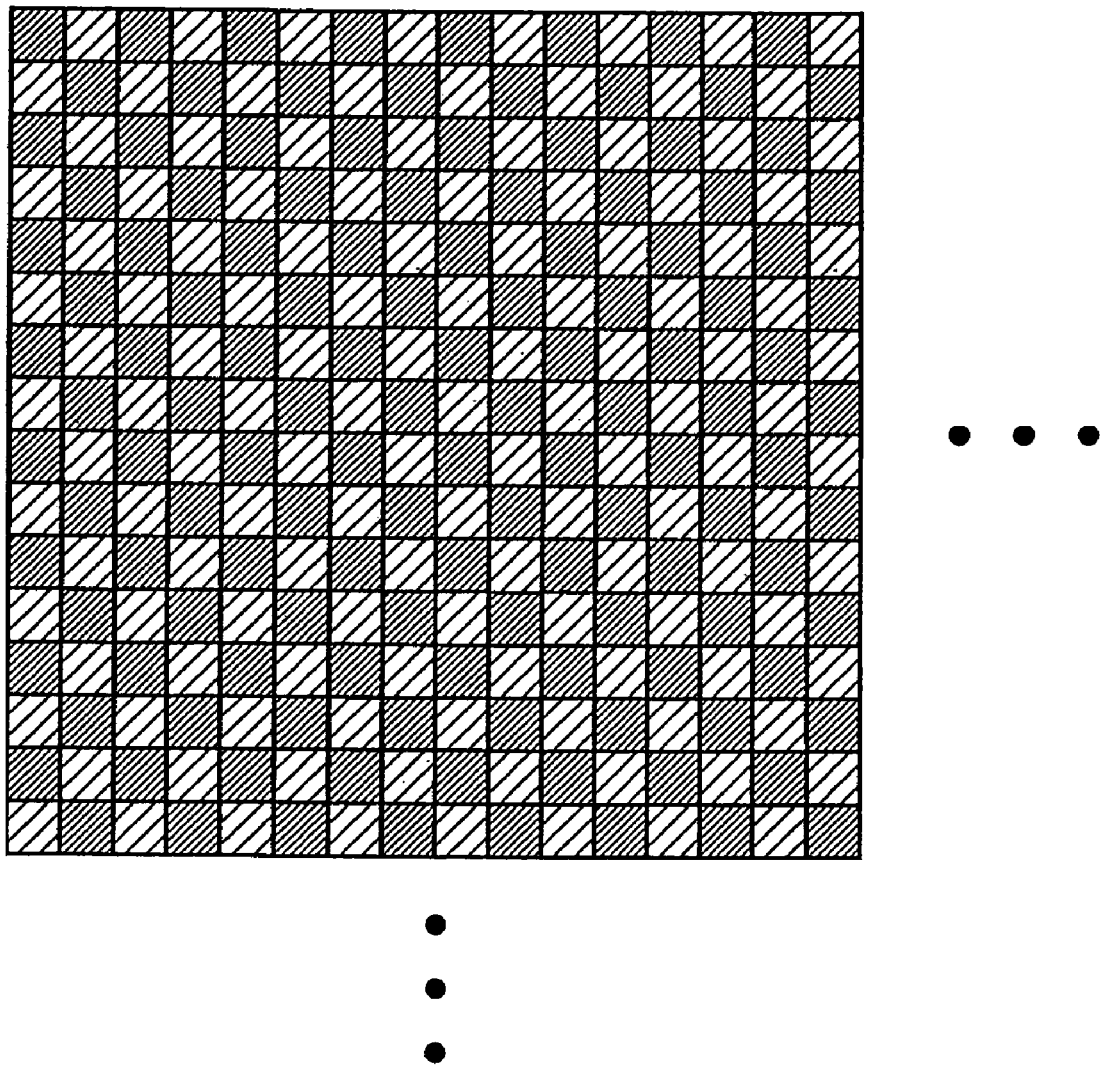
FIG. 8 is a view showing a checkered mask pattern according to the third-embodiment of the present invention.
Figure 9:
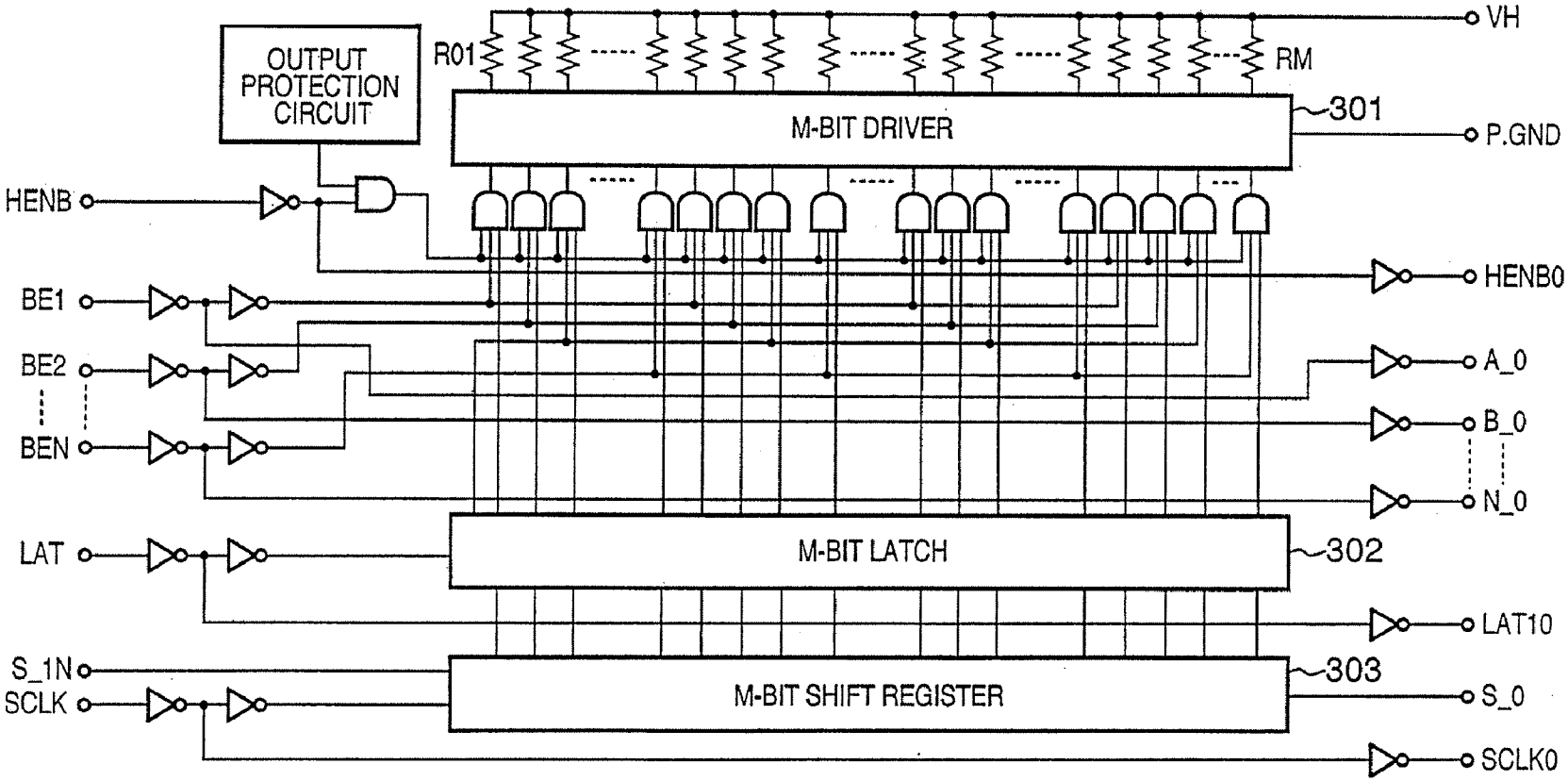
FIG. 9 PRIOR ART
FIG. 9 is a block diagram showing a general configuration of the driving circuit of an inkjet printhead using the time-divisional driving method.
Figure 10:
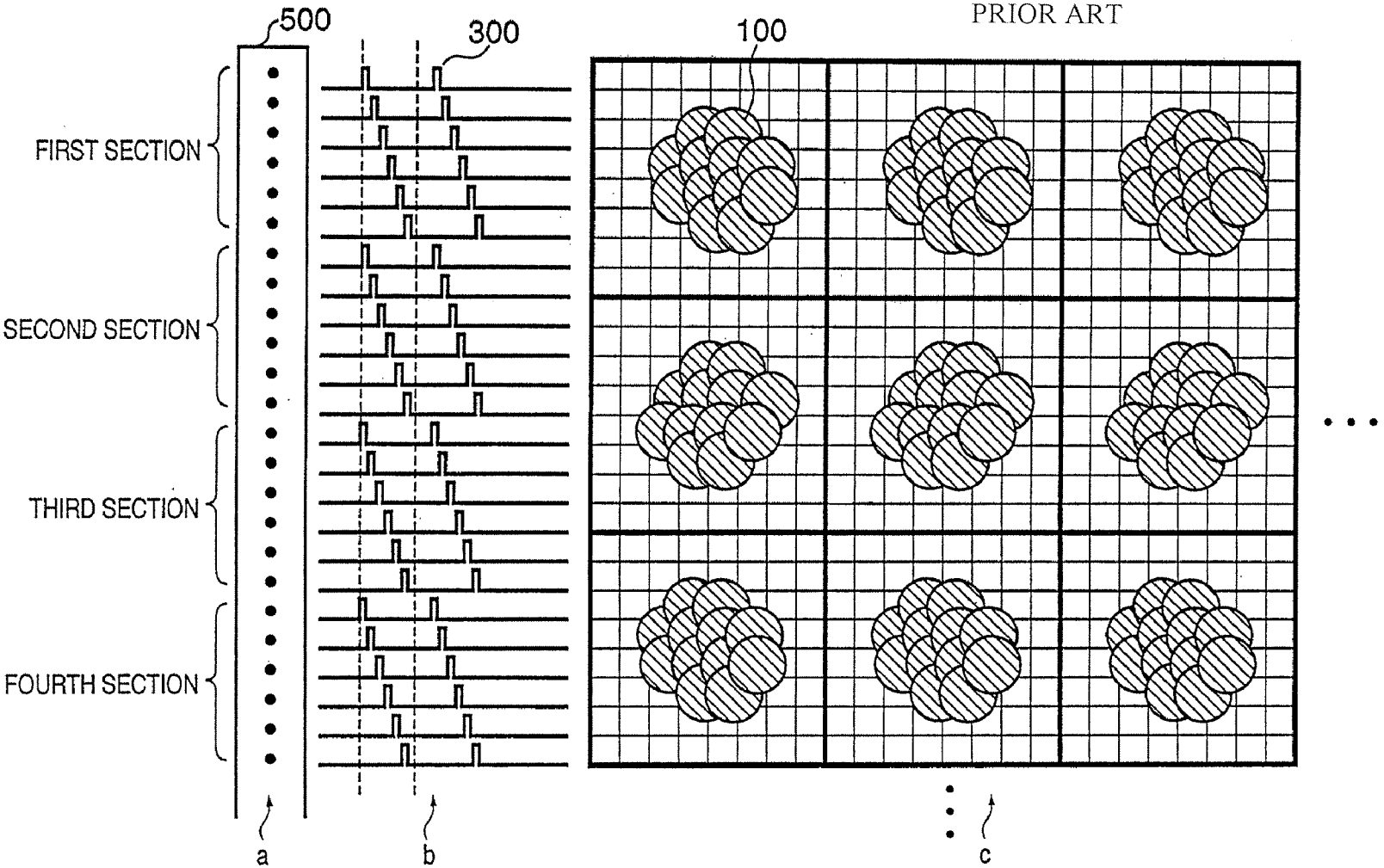
FIG. 10 PRIOR ART
FIG. 10 is a schematic view showing the relationship between the nozzle array of a printhead, a driving signal for each nozzle, and a dot which is discharged from each nozzle and attached onto a printing medium.

FIG. 8 is a view showing a checkered mask pattern as an example of a mask pattern used for 2-pass printing.

The type of mask pattern is not particularly limited, and is an arbitrary pattern such as a mask pattern having a random distribution or a gradation pattern whose average distribution changes depending on the position. With this pass mask, image data is allotted to each scanning.

According to the third embodiment described above, similar to the first and second embodiments, periodical density unevenness can be prevented even in 2-pass printing, an adverse effect between dots attached on a printing medium can be reduced, and high-quality printing can be implemented.

The third embodiment has described 2-pass printing, but the same effects can be achieved when the same configuration as that in the third embodiment is adopted for 4-pass printing, 8-pass printing, 16-pass printing, and the like.

The above-described embodiments have exemplified a clustered-dot unit matrix and execute digital-halftoning. However, the present invention is not limited to this, and may use, e.g., a dispersed-dot unit matrix.

In the time-divisional driving method described in the above embodiments, nozzles are sequentially driven in the ascending order of the nozzle number in each section. However, the present invention is not limited to this.

Of inkjet printing methods, the above embodiments adopt a method which uses a means (e.g., an electrothermal transducer or laser beam) for generating thermal energy as energy utilized to discharge ink and changes the ink state by thermal energy. This inkjet printing method can increase the printing density and resolution.

The above embodiments have exemplified a serial scan type inkjet printing apparatus, but the present invention is not limited to this. For example, the present invention can also be effectively applied to an inkjet printing apparatus using a full-line printhead having a length corresponding to the maximum width of a printable printing medium. The printhead of this type can take a structure which satisfies the length by a combination of printheads, or an integrated printhead structure.

In addition, the present invention is also effective when the serial scan type inkjet printing apparatus as described in the above embodiments uses a printhead which is fixed to the apparatus body, or an interchangeable cartridge type printhead which can be electrically connected to the apparatus body and receive ink from the apparatus body when attached to the apparatus body.

Furthermore, the inkjet printing apparatus according to the present invention may be used as an image output apparatus for an information processing device such as a computer. The inkjet printing apparatus may also be used for a copying machine combined with a reader or the like, or a facsimile apparatus having a transmission/reception function.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-355891 filed on Dec. 8, 2004, the entire contents of which are incorporated herein by reference.

What is claimed is:

1. A printing apparatus which uses a printhead having a plurality of printing elements, and comprises time-divisional driving means for dividing the plurality of printing elements into a plurality of blocks and time-sequentially driving one printing element from each of the plurality of blocks so as to print a halftone image on a printing medium in accordance with a result obtained by performing digital-halftoning for input multi-valued image data in each matrix of a predetermined size, comprising:

scanning means for reciprocally scanning the printhead;

convey means for conveying the printing medium in a convey direction different from a scanning direction of the printhead; and printing control means for controlling to print a halftone image in each matrix, wherein an arrayed direction of the plurality of printing elements is the convey direction of said convey means, said printing control means controls printing of the halftone image so as to set a size of the blocks to be equal to or an integral multiple of a size of the matrix in the convey direction, and further controls the printing of the halftone image such that a printing position of part of an area printed by the printhead in a preceding scanning by said scanning means coincides with a printing position of part of an area that partly differs from the area printed in the preceding scanning and is printed by the printhead in a current scanning by said scanning means, thereby performing multi-pass printing, and the digital-halftoning increases the number of dots from a center of the matrix as a density expressed by the multi-valued image data increases.

2. The apparatus according to claim 1, wherein the digital-halftoning includes clustered-dot digital-halftoning of fatting dots as a density expressed by the multi-valued image data increases from the center of the matrix.

3. The apparatus according to claim 1, wherein the digital-halftoning includes dispersed-dot digital-halftoning of discretely increasing the number of dots as a density expressed by the multi-valued image data increases from the center of the matrix.

4. The apparatus according to claim 1, wherein the printhead comprises an inkjet printhead which prints by discharging ink onto the printing medium.

5. The apparatus according to claim 4, wherein the inkjet printhead comprises an electrothermal transducer which generates thermal energy.

6. The apparatus according to claim 5, wherein the electrothermal transducer generates the thermal energy to be applied to ink in order to discharge the ink.

7. A printing method for a printing apparatus which uses a printhead having a plurality of printing elements, and comprises time-divisional driving means for dividing the plurality of printing elements into a plurality of blocks and time-sequentially driving one printing element from each of the plurality of blocks, and scanning means for reciprocally scanning the printhead, thereby printing a halftone image on a printing medium in accordance with a result obtained by performing digital-halftoning for input multi-valued image data in each matrix of a predetermined size, comprising:

setting an arrayed direction of the plurality of printing elements to a convey direction of the printing medium;

setting a size of the blocks to be equal to or an integral multiple of a size of the matrix in the convey direction, and controlling printing of the halftone image in each matrix; and further controlling the printing of the halftone image such that a printing position of part of an area printed by the printhead in a preceding scanning by the scanning means coincides with a printing position of part of an area that partly differs from the area printed in the preceding scanning and is printed by the printhead in a current scanning by the scanning means, thereby performing multi-pass printing, wherein the digital-halftoning increases the number of dots from a center of the matrix as a density expressed by the multi-valued image data increases.

* * * * *